US005605509A

United States Patent [19]

Gray

[11] Patent Number: 5,605,509

[45] Date of Patent: Feb. 25, 1997

[54] GOLF TRAINING DEVICE

[76] Inventor: Mark E. Gray, 4443 E. Anderson Dr., Phoenix, Ariz. 85032

[21] Appl. No.: 584,325

[22] Filed: Jan. 11, 1996

[51] Int. Cl.[6] ..... A63B 69/36

[52] U.S. Cl. ..... 473/237; 473/327; 473/238

[58] Field of Search ..... 473/238, 237, 473/327

[56] References Cited

U.S. PATENT DOCUMENTS

| | | | |
|---|---|---|---|
| 3,424,462 | 1/1969 | Driscoll | 473/238 |
| 3,758,117 | 9/1973 | Harrison | 473/238 X |
| 3,951,415 | 4/1976 | Stuart | 473/238 |
| 4,974,851 | 12/1990 | Closser et al. | 473/237 |

*Primary Examiner*—George J. Marlo
*Attorney, Agent, or Firm*—Warren F. B. Lindsley

[57] ABSTRACT

A training/playing aid for clamping on the shaft of a golf club for use in the measurement of movement in degrees that a golfer comes over the top of the ball at impact. Upon measurement of this movement, the training/playing aid is adjusted making it possible to position the golfer in a correct golf ball addressing stance. The training/playing aid comprises an elongated arm having a clamp at one end for securing the arm to the shaft of the golf club to extend laterally thereof. The clamp comprises a cylindrical shell having an opening at one side for clamping on the shaft of the golf club. The arm is streamlined with a streamlined pointer movably mounted on the arm of the golf club in a direction parallel with the head of the club with the pointer aligned with the "sweet spot" of the golf club.

3 Claims, 2 Drawing Sheets

GOLF TRAINING DEVICE

BACKGROUND OF THE INVENTION

Mastery of the game of golf is dependent upon achieving a proper golf club swing that correctly involves the simultaneous movement of the entire body of the golfer. Without a proper swing, it is impossible to drive the golf ball with consistent accuracy and with the desired force, both of which are essential to the realization of a satisfying game.

The entire golf club swing is important, including the backswing, the downswing and the follow-through. In addition to the mechanics of the swing i.e., the grip and the position and motion of the arms and body, it is also important to achieve a proper tempo and rhythm.

In addition to the above, the proper addressing of the ball is important to insure that the impact of the club with the ball occurs at or near the ideal location or "sweet spot" on the face of the club.

Having directed many hours of practice toward the achievement of the proper form and swing, the typical golfer and perhaps 98 percent of all golfers tend to "come over the top" of the golf ball, i.e. the point of impact will be displaced from the "sweet spot" in the direction of the toe of the club. Other golfers, much fewer in number, will quite consistently miss the "sweet spot" with displacement in the opposite direction. In either case the displacement tends to occur even though the ball is actually addressed at the "sweet spot" location. The result in both cases is loss of distance and a directional error. The golfer also experiences the feeling of having not connected solidly with the ball.

This problem can be overcome by addressing a point on the club face that is displaced from the "sweet spot" by a distance equivalent to the observed displacement of the point of impact from the point of address. The observed displacement will be different for different golfers.

What is needed is a training device that enables the individual golfer to determine the appropriate point of address that will consistently result impact at or near the "sweet spot" of the club face.

SUMMARY OF THE INVENTION

In accordance with the invention claimed, a new practice device or training aid is provided for use by golfers in the determination of a point of address that will result in impact between the ball and the club at a location near the "sweet spot" of the club face.

It is, therefore, an object of the present invention to provide a new practice device or training aid for use by golfers in the development of an improved ball address technique.

Another object of this invention is to provide such a practice device or training aid in two parts, the first part comprising a marking or monitoring means that identifies and displays the point of impact and the second part comprising a sighting or pointing means for use in addressing the ball.

A further object of the invention is to provide such a practice or training device in a form that permits the individual golfer to evaluate his instant performance relative to an appropriate address and point of impact and to determine the required adjustment essential to the achievement of an ideal point of impact at or near the "sweet spot" of the club face.

A still further object of this invention is to provide such a practice device in an inexpensive form that is readily affordable by the average golfer.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings in which.

DESCRIPTION OF THE PREFERRED EMBODIMENT

Figure 1:
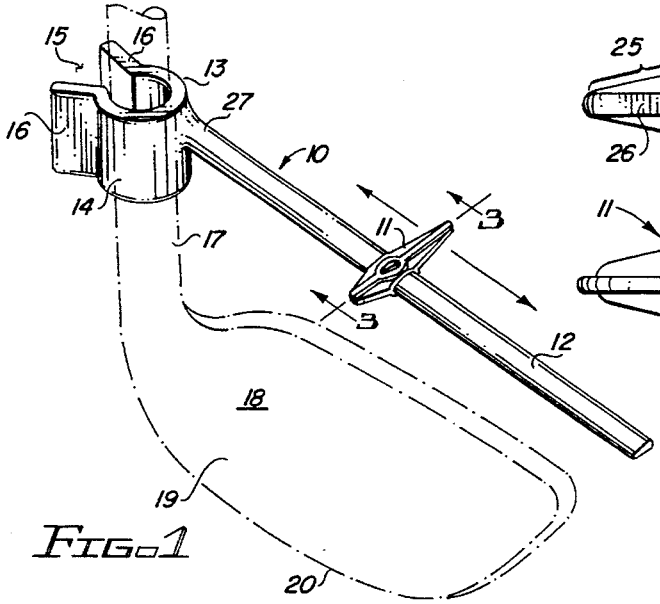
FIG. 1 is a first perspective rear view of the sighting or pointing means of the invention with its attachment to a golf club, illustrated by the broken line representation of the club.

Referring more particularly to the drawings by characters of reference, FIGS. 1–6 disclose a first embodiment of the sighting or pointing means 10 of the invention, the sighting or pointing means comprising a movable pointer 11, an arm 12 and an integral clamp 13 for securing the pointing means to the shaft of a golf club.

The clamp 13 is in the form of a partial cylindrical shell 14 with a longitudinal opening 15 at one side. Extending from the edges of opening 15 are diverging flanges 16. The inside diameter of shell 14 is substantially equal to but slightly smaller than the diameter of the shaft 17 of a golf club 18. Clamp 13 and integral arm 12 are made of Lexan 121 (General Electric Co.) or other flexible plastic material so that clamp 13 may be forced into position over the shaft 17 of the golf club. As the shaft 17 enters the clamp via opening 15, the flanges 16 and the shell 14 open to receive the shaft and then return substantially to the rest position to grip the shaft and securely maintain the set position of the clamp and of the pointing means 10.

Figure 6:
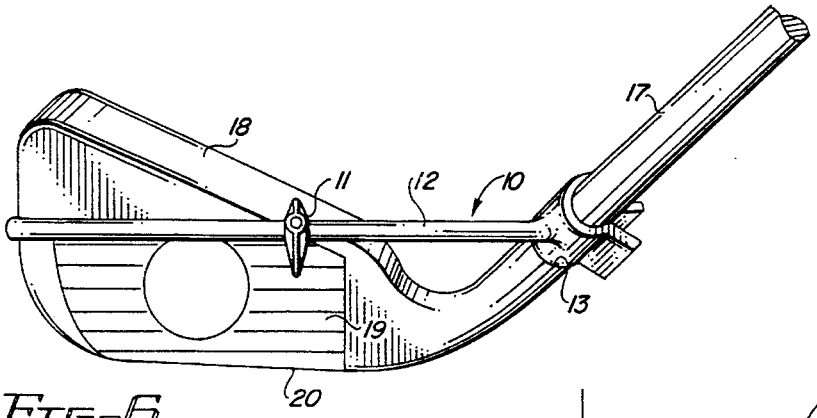
FIG. 6 is a front view showing the pointing means attached to the golf club.

Arm 12 extends from the surface of clamp 13 at a point generally opposite from opening 15 and at an angle relative to the axis of shell 14 that permits arm 12 to be aligned parallel with the extension of the head 19 of club 18 or more particularly, parallel with the sole 20 of the head 19 in the case of the irons shown in FIGS. 1 and 6.

Arm 12 is approximately equal in length to the average heel-to-toe dimension of a golf club. Its cross-section 12, as shown in FIG. 3, is streamlined to reduce wind resistance preferably taking the form of an airfoil with the wider leading edge tapering to a smaller dimension at the trailing edge.

Figure 2:
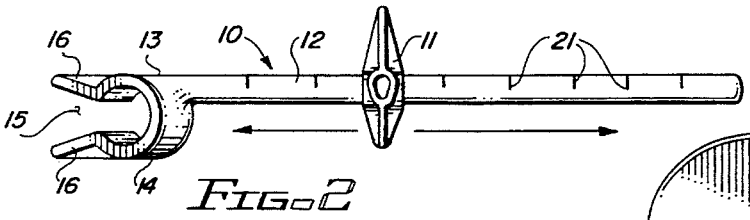
FIG. 2 is a perspective top view of the pointing means of FIG. 1.

As shown in FIG. 2, position markers 21 may be provided along the length of arm 12 at half-inch intervals or other appropriate increments.

Pointer 11 is slidably mounted on arm 12, projecting perpendicularly therefrom with arm 12 extending through an opening 22 in the body of pointer 11. An aperture 23, as shown in FIG. 3, may be provided at one side of opening 22 to enhance the clamping action that holds the set position of pointer 11 on arm 12 while permitting initial assembly and position adjustments.

Figure 3:
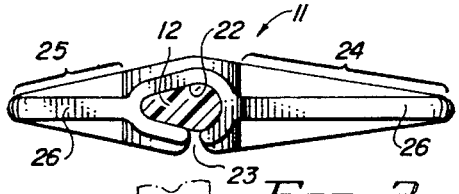
FIG. 3 is a cross-sectional view of FIG. 1 taken along the line 3—3.
Figure 4:
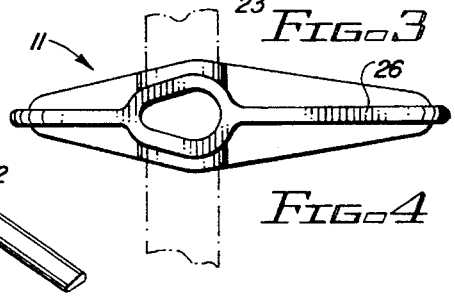
FIG. 4 is a top view of the pointing means of FIG. 1.

FIGS. 3 and 4 show side and top views, respectively, of pointer 11. Pointer 11 has a tapered or pointed nose 24, approximately one-half inch long and a shorter tapered tail 25. The longer pointed nose 24 is intended to be directed toward the targeted destination of the ball and is to be aligned vertically with the center of the ball as the ball is addressed. Ribs 26 are incorporated as stiffeners, and again a streamlined design is employed to reduce wind resistance. The pointer 11 is preferably fabricated of a flexible plastic material that permits it to grip the surface of arm 12 while being slidably mounted thereon.

Figure 5:
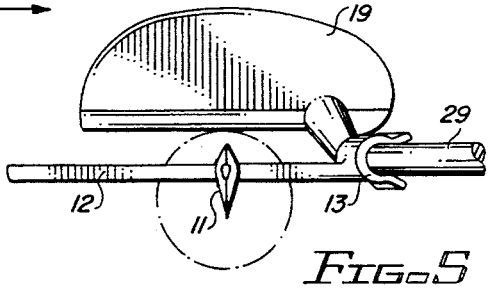
FIG. 5 is a top view showing the pointing means attached to the golf club, in this case to a putter.

As shown in FIGS. 1, 5 and 6, the pointing means 10 and pointer 11 are mounted above or just forward of the head of the golf club with the pointer positioned above the club face and pointed in the direction of the golfer's swing. This orientation is somewhat facilitated by the attachment of arm 12 to a point 27 near the leading edge of clamp 13 rather than at the center of the clamp 13 which lies directly above the club head.

Figure 7:
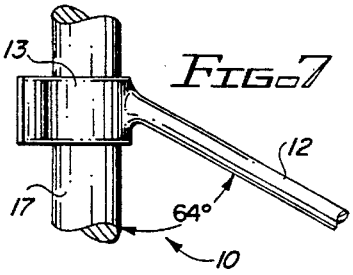
FIG. 7 is a side view of the pointing means showing the angular relationship between parts of the invention.
Figure 11:
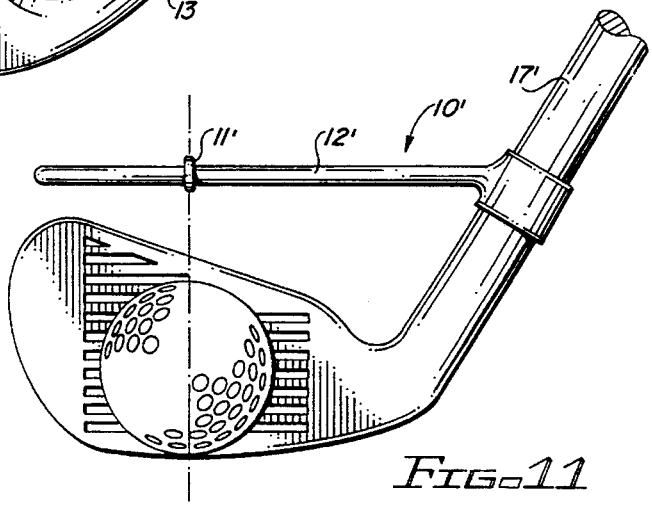
FIG. 11 is a front view showing the pointing means of FIGS. 7, 8 and 9 mounted on a golf club.

With the above orientation of the pointing means 10 relative to the head of the golf club, it is possible to position the pointer directly above the "sweet spot" on the club face or at positions on either side of the sweet spot in the direction of the heel or toe of the club head. This is true in the case of the irons shown in FIGS. 1, 5 and 6. To achieve such an orientation of the pointer 11, the angle between the arm 12 of pointing means 10 and the shaft 17 of the golf club may be approximately 64 degrees as shown in FIG. 7 or any other suitable angle.

For use with woods or drivers, a somewhat different angular relationship may be required.

variations in the form of pointing means 10, clamp 13 and/or the pointer 11 may be made without compromising the operation of the pointing means. FIGS. 8, 9, 10 and 11, for example, show a second embodiment 10' of pointing means 10, the pointing means 10' incorporating a modified clamp 13', a modified arm 12' and a modified pointer 11.

Figure 8:
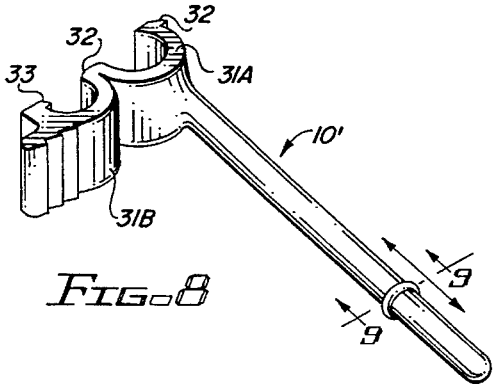
FIG. 8 is a perspective view showing a second embodiment of the pointing means of the invention.
Figure 10:
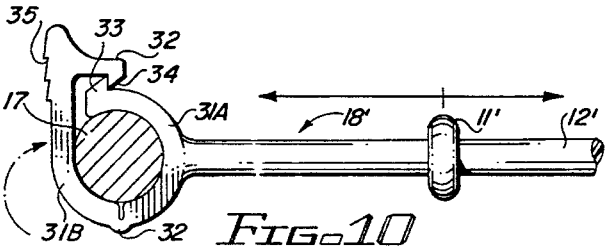
FIG. 10 is a cross-sectional view of the pointing means of FIG. 7 illustrating its attachment to the shaft of a golf club.

As shown in FIGS. 8 and 10, the clamp 13' comprises two cylindrical half sections, 31A and 31B, longitudinally joined by a hinge 32 in the form of an integral web or membrane of the same plastic material.

The opposite edges of the sections 31A and 31B are shaped to form cooperating members of a self-latching buckle. Section 31A carries an outwardly-directed sloped projection 33 and section 31B carries an inwardly-directed sloped projection 34. As shown in FIG. 10, when the shaft 17 of a golf club is first placed inside section 31A, section 31B may then be wrapped around the protruding position of shaft 17. As this is done, projection 34 rides over the sloping outer edge of projection 33 and snaps into the secured position with projections 33 and 34 mutually engaged. Serrated grooves 35 on the outside surface of section 31B serve as a grip for closing clamp 13'.

Figure 9:
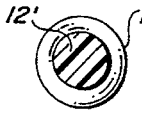
FIG. 9 is a cross-sectional view of FIG. 8 taken along line 9—9.

Modified pointer 11', as shown in FIGS. 8, 9, 10 and 11, comprise an ordinary "O-ring", typically made of rubber or neoprene. To accommodate the circular central opening of the O-ring, the arm 12' has a circular cross-section as shown in FIG. 9. The diameter of arm 12' should be slightly greater than the unstressed diameter of the central opening of the O-ring so that the pointer 11' may be positioned at any point along the length of arm 12' and will remain in the set position during the golf stroke.

Figure 12A:
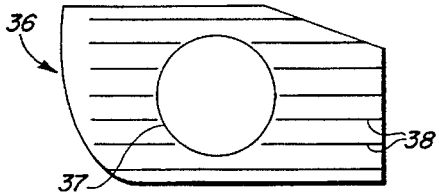
FIG. 12A shows a first embodiment of the marking or monitoring means of the invention.

The marking or monitoring means of the invention is shown in a first embodiment in FIG. 12A in the form of an impact marker 36. Marker 36 comprises a label shaped and dimensioned to cover the greater part of the face of a golf club. It is made of a pressure sensitive material with an adhesive backing. The ideal point of impact or "sweet spot" location is identified by a circle 37 imprinted on the face of the marker. Additional optional markings such as horizontal lines 38 give the appearance of the uncovered face of a typical golf club.

Figure 12B:
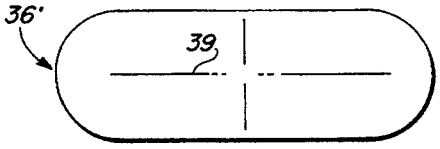
FIG. 12B shows a second embodiment of the marking or monitoring means of the invention.

Some form of marking identifying the "sweet spot" such as the circle 37 is essential to the practice of the invention. In a second embodiment, 36' of marker 36, as shown in FIG. 12B, the "sweet spot" is identified by the intersection of two perpendicular lines 39.

First and second embodiments of the elements of the invention have now been described with reference to FIGS. 1–12. The application of the invention as an aid in the improvement of the golfer's skills will now be described with reference to FIGS. 13A, 13B, 13C and 13D.

Having mounted the pointing means 10 or 10' to the shaft of the golf club and having affixed the marking means 36 or 36' to the face of the club, the golfer takes his stance in preparation for addressing the ball.

Figure 13A:
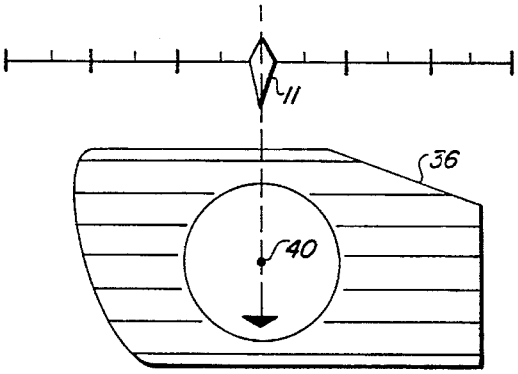
FIGS. 13A—13D illustrate in successive stages the utilization of the golf training device of the invention for the correction of a golfer's addressing technique.

In preparation for the first step of the training routine, the pointer 11 is set directly above the "sweet spot" 40 of the club as shown in FIG. 13A. The ball is then addressed by setting the club next to the ball and aligning the pointer 11 with the center of the golf ball. Having thus addressed the ball, the golfer executes his stroke in the usual manner.

With the pointer setting remaining directly over the "sweet spot" of the club and continuing to align the pointer with the center of the ball, a number of strokes are executed. For each stroke, a point of impact 41 will be registered on marker 36. After a significant number of such strokes, an average displacement 42 will be apparent from the observed pattern of impact locations on the marker.

Figure 13C:
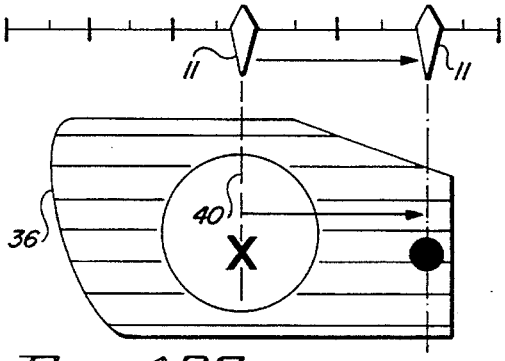
Figure 13B:
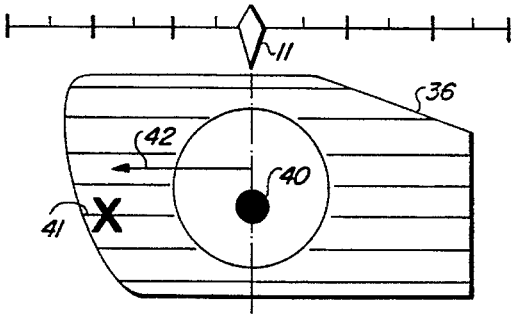

To compensate or correct for the golfer's apparent tendency to achieve a point of impact, a given distance 42 and in a given direction from the point of address, the point of address must logically be moved the same distance in the opposite direction from the "sweet spot". To accomplish this, pointer 11 as shown in FIG. 13C, is moved a distance 42 to the right of the "sweet spot" 40 to correct for the impact displacement 42 of FIG. 3B which is to the left of the "sweet spot". Position markers 21 on arm 12 provide points of reference approximately ½ inch apart which will facilitate adjustments of the pointer position. The ball is then addressed by aligning the pointer 11 with the center of the ball.

Figure 13D:
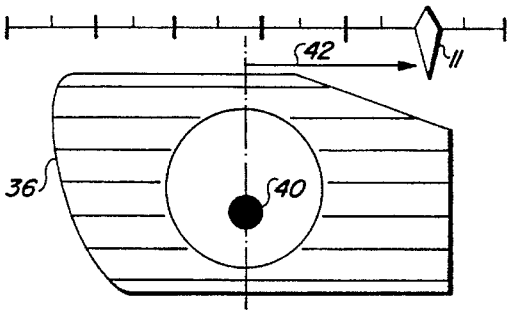

The marker 36 should at this point be replaced by a fresh marker. With the pointer located as described above, a number of shots are then taken, each time addressing the ball with the ball and pointer aligned. The pattern of impact markings obtained in this manner should then be centered at or near the "sweet spot" 40 as shown in FIG. 13D.

At this point in the training routine, the golfer may choose to proceed without further use of the marking means, but retaining the use of the pointer which remains set in the appropriate position on the arm of the training device.

After a series of practice sessions with the aid of the pointing means 10 and the impact marker 36, the golfer will have obtained a "feel" for the desired orientation of the club relative to the ball during the address phase of the golf stroke. It should then be possible to discard the training aids of the invention and realize a substantial improvement in golfing skill.

While the pointing means and the marking means have been shown to complement each other as a complete and effective training aid, each element may be effectively used alone. The pointer may be used alone as an addressing aid once the desired displacement has been determined. The marking means might also be used alone after the full practice routine as described herein has been abandoned and when it is desired to run a check on how accurately or how consistently the "sweet point" is being impacted.

It should be recognized that the present invention is applicable for drivers and putters as well as for irons and for left-hand clubs as well as for right-hand clubs. For left-hand versions, the pointing means will appear as mirror images of the right-hand versions.

It should be noted that the device shown and described herein identifies the degree of error or "over the top" movement of the club head and teaches the golfer how to benefit from his or her understanding of its effect. Arm 10 teaches the golfer how to properly square the golf club to the target.

Although but a few embodiments of the invention have been illustrated and described, it will be apparent to those skilled in the art that various changes and modifications may be made therein without departing from the spirit of the invention or from the scope of the appended claims.

What is claimed is:

1. A training/playing aid for clamping on the shaft of a golf club for use in the development of an appropriate ball address consistent with the individual golfer's characteristic swing, said aid comprising:

an elongated arm having a clamp at one end for securing said arm to said shaft of the golf club to extend laterally thereof, said clamp comprising a cylindrical shell having an opening at one side, said opening incorporating diverging flanges which allow said clamp to be snapped into position about the shaft of the golf club where its position will be securely sustained by the gripping action of said clamp, said arm having a streamlined periphery for minimizing air resistance introduced by said golf club during a golf club swing, a pointer movably mounted on said arm provided with an opening extending therethrough having a periphery of the same shape as the periphery of said arm, said arm passing through said opening in said pointer with sufficient interference between said arm and the periphery of said opening so as to assure that when said pointer is set to a desired position along the length of said arm, said position will be sustained throughout the normal stresses experienced during a golf club swing, and said arm of said aid extending laterally from the shaft of the golf club in a direction parallel with the head of the golf club and passes directly over and above the face of the golf club when the device is attached to the shaft of the golf club by said clamp, whereby the pointer is aligned with the "sweet spot" of the golf club and movable to positions on either side of the "sweet spot", the pointer serving as a point of reference for aligning the golf club with the golf ball at the correct point of impact, allowing for maximum consistency due to proper pre-impact positioning.

2. The training device set forth in claim 1 for clamping on the shaft of a golf club for use in the development of an appropriate ball address in further combination with:

a marking means that identifies the point of impact between a golf ball and the face of the golf club, said marking means comprising:

a label shaped to cover the impact area of the face of the golf club, said label having an adhesive backing that allows said label to be removably affixed to the face of the golf club and said label being made of a pressure sensitive material that sustains a visible indication of a point of impact between a golf ball and the face of the golf club.

3. The training/playing aid set forth in claim 2 wherein:

said marking means incorporates a printed pattern that identifies the location of the "sweet spot" of the golf club and provides for calibration while measuring degree of inconsistency in individual's swing at impact of the golf club with a golf ball.

* * * * *